United States Patent [19]

Bagg

[11] Patent Number: 4,553,752

[45] Date of Patent: Nov. 19, 1985

[54] GOLF APPARATUS

[76] Inventor: Robert D. Bagg, 387 Chestnut St., Oneonta, N.Y. 13820

[21] Appl. No.: 674,497

[22] Filed: Nov. 23, 1984

[51] Int. Cl.[4] ..... A63B 57/00

[52] U.S. Cl. ..... 273/32 A; 273/162 D; 15/160; 15/184

[58] Field of Search ..... 273/32 R, 32 A, 32 B, 273/162 R, 162 D, 162 F; 15/160, 184

[56] References Cited

U.S. PATENT DOCUMENTS

| | | | |
|---|---|---|---|
| 1,756,141 | 4/1930 | Spellmeyer | 273/162 D X |
| 2,739,331 | 3/1956 | Goodman | 15/184 |
| 2,892,633 | 6/1959 | Eckert | 273/162 D |
| 3,349,422 | 10/1967 | Heil | 273/162 R X |
| 3,774,913 | 11/1973 | Dien | 273/32 B X |
| 3,999,243 | 12/1976 | LaPour | 273/32 B X |

FOREIGN PATENT DOCUMENTS

| | | | |
|---|---|---|---|
| 522100 | 2/1956 | Canada | 273/32 A |

*Primary Examiner*—William H. Grieb

*Attorney, Agent, or Firm*—Richard G. Stephens

[57] ABSTRACT

A golf club handle includes a powder-carrying chamber which may be opened or closed by movement of a brush-carrying cap. Axially-removable and rotatable forms of caps are disclosed.

4 Claims, 3 Drawing Figures

GOLF APPARATUS

My invention relates to golfing apparatus, and more particularly, to convenient and economical apparatus which allows a player to mark a ball position, as on a green, and then to remove the mark.

In a common golfing situation, a plurality of players, such as some or all of a foursome, have played their balls onto a putting green, and the player whose turn it is to putt finds that one or several balls of one or more of the other players either lie near the cup, or near the line between the cup and the ball of the player whose turn it is to putt, so that his ball well might strike the ball of another player as he putts. Courtesy and fair play dictate that balls nearer the cup, or near the mentioned line be temporarily removed. It long has been common for players nearer the cup or near the mentioned line to temporarily remove their balls, marking their ball positions with some type of marker, so that they can be accurately replaced. A coin is frequently used as a marker. A coin tends to be a poor form of marker, since it sometimes can appreciably change the path of a ball which encounters it. The art has recognized that a small deposit of powder may provide a much better marker, and it previously has been proposed that means for depositing powder marks be installed in golf clubs. U.S. Pat. No. 2,892,633 shows a powder dispenser contained in the head of a golf club, and U.S. Pat. No. 1,756,141 shows a powder dispenser in the end of the handle of a golf club.

While the use of powder dispensers eliminates the problems associated with the use of coins as markers, it tends to cause other problems. At a busy golf course, the putting greens may soon become covered with numerous powder marks, and if a green carries numerous powder marks such marks become self-defeating—a player may not be able to recognize the particular mark where he should replace his ball, and arguments may develop among members of a foursome. The accumulation of numerous powder marks on a green could be obviated if players were to remove such marks when replacing their balls. Golf players tend to be somewhat considerate of others, and they are likely to remove powder marks, just as they often replace divots, if some convenient and effective way of removing such marks is provided. In the past there has been no effective and convenient way to remove or obscure powder marks of the types provided by the golf clubs of the above-mentioned patents. It should be recognized that merely stepping on such a powder mark tends to rather permanently implant the mark on the green rather than to remove it. The cleats on usual golf shoes theoretically enable a golfer to wholly and rapidly eradicate a powder mark, but only if he seriously defaces what may be a well manicured green, which certainly is not to be encouraged. In accordance with the present invention, convenient and economical means for removing powder marks are provided, in the form of a small fine-bristled brush which mounts on the end of a putter handle, closing off a powder dispenser which is also provided in the putter handle. Thus a primary object of the present invention is to provide means for conveniently erasing or obscuring powder marks on a green which comprises a small brush-carrying member which acts to open and close off a powder dispenser opening.

The broad idea of mounting a brush on a golf club is not per se new. U.S. Pat. No. 3,349,422 and 3,999,243 show brushes attached to golf clubs; however, those brushes are large brushes intended to sweep leaves or debris, rather than a small brush like the present invention contemplates, and the brushes of those patents do not close off a powder-carrying recess in the handle of a golf club.

Another object of the invention is to provide a brush on the handle of a putter which does not interfere with normal putting. A further object of the invention is to provide means which can be readily added to many existing putters, as well as being incorporated in newly-manufactured putters.

Other objects of the invention will in part be obvious and will in part appear hereinafter.

The invention accordingly comprises the features of construction, combination of elements and arrangement of parts, which will be exemplified in the constructions hereinafter set forth, and the scope of the invention will be indicated in the claims.

For a fuller understanding of the nature and objects of the invention reference should be had to the following detailed description taken in connection with the accompanying drawings, in which.

Figure 2:
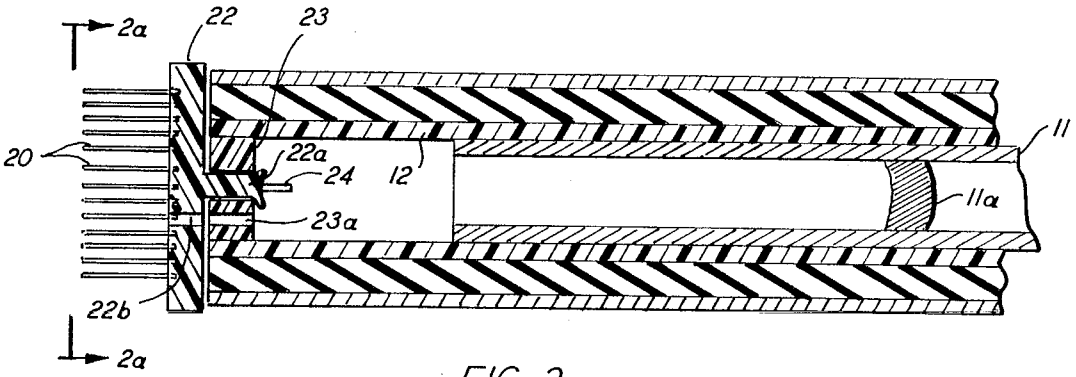
FIG. 2 is a cross-section view at the mid-section of the handle portion of an alternative golf club incorporating the present invention.

FIG. *2a* is an end view taken at lines *2a—2a* in FIG. 2.

Figure 1:
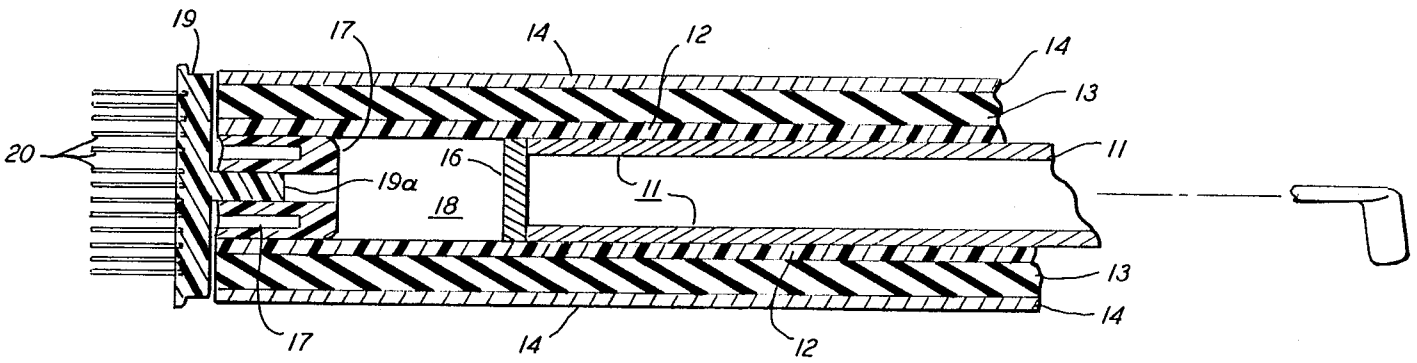
FIG. 1 is a cross-section view at the mid-section of the handle portion of one form of golf club incorporating the present invention.

In FIG. 1 the upper end of the metal hollow shaft of a conventional putter is shown at 11. For a length along the handle portion of the putter, shaft 11 is covered with a hollow rigid plastic sleeve 12, and plastic sleeve 12 is covered by an elastomeric (rubber or equivalent) sleeve 13. A leather (or synthetic leather) strap 14 is wound around and cemented to the outside surface of sleeve 13 to provide the gripping surface which the player grips when using the club.

The end of hollow shaft 11 is shown closed off by a plastic disk 16 cemented in place. A plastic ring member 17, disk 16 and plastic sleeve 12 form a cylindrical chamber 18 in which powder (not shown) may be stored. Ring member 17 is shown located inside plastic sleeve 12 near the end of the handle, and it may be secured in that position either by cement or by a tight friction fit.

A plastic cap member 19 comprises an annular disk having a plurality of brush bristles 20,20 affixed to its outer side, and an integral shaft portion 19*a*, which may be metal or plastic. Ring member 17 includes an annular slot 17*a*. As cap 19 is pushed in place, to the position shown, shaft portion 19*a* of the cap spreads apart the portion of ring member 17 which it engages, so that friction thereafter holds cap 19 in place until it is intentionally removed. Cap 19 is preferably provided with a lip portion 19*b* of enlarged diameter to facilitate installation and removal of cap 19.

When a player desires to mark the spot of a ball on a green, he need merely remove cap 19 and invert the putter, with the handle end placed over the spot to be marked, and powder then will fall from chamber 18 through the central bore of ring member 17 onto the green to mark the spot. Then the player can immediately replace cap 19 to the position shown. Later, when he replaces his ball, the player can brush away the powder, using the bristles 20,20 on the handle end of his putter. Because bristles 20 are confined within the diametrical extremities of cap 19 and the handle of the putter, and not located where the player grips the putter, the bristles never interfere with normal operation of the putter, nor need their presence even be noticed by the user unless he deems marking of a ball position necessary.

It will be apparent that parts 16,17 and 19 may be readily installed in the handle of an existing putter after merely drilling a hole down into the handle, and it will be obvious that putter handles may be manufactured in the future to incorporate such parts.

Figure 2A:
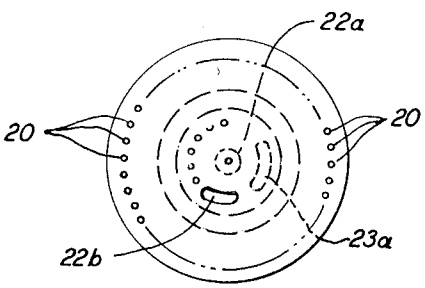

In the alternative embodiment illustrated in FIGS. 2 and 2*a*, a plastic plug 11*a* has been forcefully pushed a substantial distance into hollow metal shaft 11, so that a substantial amount of powder (not shown) may be contained within the shaft. The plastic cap member 22 comprises a disk affixed to a central shaft 22*a*, with an axially-extending and partially circumferentially extending slot 22*b* provided through the disk at a radial distance from central shaft 22*a*. The outside of cap member 22 carries a plurality of bristles 20,20 spaced over all of the disk except for an area adjacent slot 22*b*. Shaft 22*a* rotatably extends through a central hole in ring member 23, and the end of shaft 22*a* is widened to retain ring member 23 on shaft 22*a*. Ring member 23 is provided with a partially circumferentially extending slot 23*a* best seen in FIG. 2*a*.

When cap 22 is rotated so that all or a portion of slot 22*b* registers with all or a portion of slot 23*a*, powder may fall from the club through those slots, when the club is inverted, and when no portions of the two slots register powder will not escape. It will be apparent that how much powder will be dispensed from a given amount of inverted jiggling of the club will depend upon how much of the two slots register, and hence the user can adjust the amount of powder used to make a mark on the green. Rotatable cap member and ring member 23 are maintained on the end of the club by the friction of member 23 against plastic sleeve 12. A slit 24 is shown provided in sleeve 12 to allow it to slightly expand when ring member 23 is forced into it. Cap member 22 and ring member 23 can be pried off the end of the club when it becomes necessary to refill the powder chamber. If desired, ring member 23 may be permanently cemented in the end of sleeve 12 in the position shown, and refilling of powder then done through slots 22*b* and 23*a* with those slots registered, using a small funnel (not shown) which extends between brush bristles into slot 22*b*.

It is contemplated that cap members 19 and 22 and ring members 17 and 23 preferably will be molded nylon or propylene, and that the bristles will be nylon or other suitable plastic. It will be apparent that the invention may be fabricated very inexpensively.

It will thus be seen that the objects set forth above, among those made apparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

The embodiments of the invention in which an exclusive property or privilege is claimed are defined as follows:

1. In a golf club having a generally-cylindrical handle portion, the combination of: a chamber adapted to carry powder formed in said handle portion; and cap means on said handle, said cap means carrying brush means on an exterior surface of said cap means, and said cap means being movable to open and close said chamber to allow powder to fall from said chamber.

2. The club according to claim 1 wherein said brush means comprises a plurality of bristles extending generally parallel to the shaft of said golf club.

3. The club according to claim 1 having ring means partially defining said chamber, said ring means having a through bore, and said cap means having plug means insertable into and removable from said through bore.

4. The club according to claim 1 having ring means partially defining said chamber, and ring means having a through slot, said cap means being rotatably affixed to said ring means and having a through slot, whereby rotation of said cap means relative to said ring means may cause said through slots to register or not to register.

* * * * *